United States Patent [19]

Anderson et al.

[11] Patent Number: 4,919,300

[45] Date of Patent: Apr. 24, 1990

[54] SHIPPING DEVICE

[75] Inventors: Kristy L. Anderson, Allegheny County; Edward R. Bollinger, Westmoreland County, both of Pa.

[73] Assignee: RJ Lee Group, Inc., Monroeville, Pa.

[21] Appl. No.: 332,527

[22] Filed: Mar. 31, 1989

[51] Int. Cl.[5] ..... B65D 81/00

[52] U.S. Cl. ..... 220/408; 220/23.83; 206/583

[58] Field of Search ..... 220/408, 435, 23.83, 220/23.86, 1 T; 206/583, 594

[56] References Cited

U.S. PATENT DOCUMENTS

| | | | |
|---|---|---|---|
| 1,152,308 | 8/1915 | Evans | 220/408 |
| 1,336,702 | 4/1920 | Juricich . | |
| 2,042,426 | 5/1936 | Kinzel | 206/583 X |
| 2,335,779 | 11/1943 | Mazzei | 206/583 X |
| 2,885,565 | 5/1959 | Davis | 250/231 |
| 2,901,208 | 8/1959 | Jones | 248/346 |
| 2,977,043 | 3/1961 | Scheldorf | 206/583 X |
| 3,357,589 | 12/1967 | Spaulding et al. | 206/583 X |
| 3,863,587 | 2/1975 | Bosnich | 114/191 |
| 4,013,170 | 3/1977 | Hutterer | 206/583 X |

*Primary Examiner*—Steven M. Pollard

*Attorney, Agent, or Firm*—Webb, Burden, Ziesenheim & Webb

[57] ABSTRACT

A shipping device for transporting an item includes a cubical frame having six faces wherein at least one of the faces is removably fastened. The shipping device also includes a hollow sphere for receiving the item concentrically positioned within the cubical frame. The hollow sphere has an upper hemisphere shell and a lower hemisphere shell. The upper hemisphere shell has a rim to mesh with a complimentary rim of the lower hemisphere shell. A weight member is secured to a bottom of the lower hemisphere shell for at least counterbalancing the weight of the item. The shipping device further includes a plurality of ball bearings secured to a center of each of the six faces. The ball bearings operatively contact a surface of the hollow sphere such that as the orientation of the cubical frame is altered, the hollow sphere rotates within the cubical frame to maintain the sphere in a specific orientation. The shipping device may also include an energy absorbent material having a cavity therein shaped to hold the item to be transported.

16 Claims, 2 Drawing Sheets

SHIPPING DEVICE

FIELD OF THE INVENTION

This invention relates to shipping devices. More particularly, this invention relates to shipping devices for transporting an item requiring a specific orientation.

DESCRIPTION OF THE PRIOR ART

The demand to transport an item from one location to another in the private, public and industrial sectors of the world has increased significantly. In the transporting of an item from one point to another it is sometimes necessary to insure that the item remains in a specific orientation during the journey in order to maintain the integrity and the safety of the item. To achieve this, expensive special handling, including in many instances, hand carrying is required, and even then it is difficult to maintain the required orientation. Accordingly, improved methods for simply and efficiently transporting an item in a specific orientation are required.

Various devices for maintaining the orientation of an object are known, but are not suitable for transporting an item in a specific orientation. For example, U.S. Pat. No. 1,336,702 discloses a basket mounted on an airplane which by the use of a large counterweight and a ball bearing mount will maintain the orientation of the basket regardless of the attitude of the airplane. U.S. Pat. Nos. 2,885,565 and 2,901,208, both disclose structures similar to a binnacle for a compass which maintain the instrument in a horizontally oriented position regardless of the position of the vehicle to which it is attached. These arrangements are far more complex than the present invention and accordingly are not suitable as a device for transporting an item requiring a specific orientation.

To alleviate the aforementioned problems we have invented a new type of shipping device that insures automatically that the contents of the device are maintained at all times in a preselected specific orientation.

Accordingly, it is an object of the present invention to provide a shipping device for transporting an item to maintain the item in a specific orientation. Another object of the present invention is to ensure that an item transported inside the shipping device will always remain upright and secure regardless of the orientation of the shipping device. It is a further object of the present invention to provide a shipping device for maintaining an item in a specific orientation that is simple and economical to manufacture.

SUMMARY OF THE INVENTION

Briefly, according to this invention, there is provided a shipping device for transporting an item including a housing and a hollow container positioned within the housing. The hollow container has an upper shell half and a lower shell half. The shipping device also includes a counterbalancing means secured to the bottom of the lower shell half for at least counterbalancing the weight of the item, and a bearing means to permit rotation of the hollow container within the housing to maintain the hollow container in a stable position by the force of gravity acting upon the counterbalancing means.

More particularly, the shipping device for transporting an item includes a cubical frame having six faces wherein at least one of the faces is removably fastened. The shipping device also includes a hollow sphere concentrically positioned within the cubical frame. The hollow sphere has an upper hemisphere shell and a lower hemisphere shell. The upper hemisphere shell has a rim to mesh with a complimentary rim of the lower hemisphere shell for opening of the hollow sphere to permit placement of the article(s) to be shipped within the hollow sphere in a fixed array therein. A weight member is secured to a bottom of the lower hemisphere shell for at least counterbalancing the weight of the item. The shipping device further includes a plurality of bearings secured to a center of each of the six faces. The bearings operatively contact a surface of the hollow sphere such that as the orientation of the cubical frame is altered, the hollow sphere rotates within the cubical frame to maintain the sphere in a specific orientation.

The shipping device may also include an energy absorbent material for placement within the sphere, the energy absorbing material having a cavity herein shaped to hold the item to be transported.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
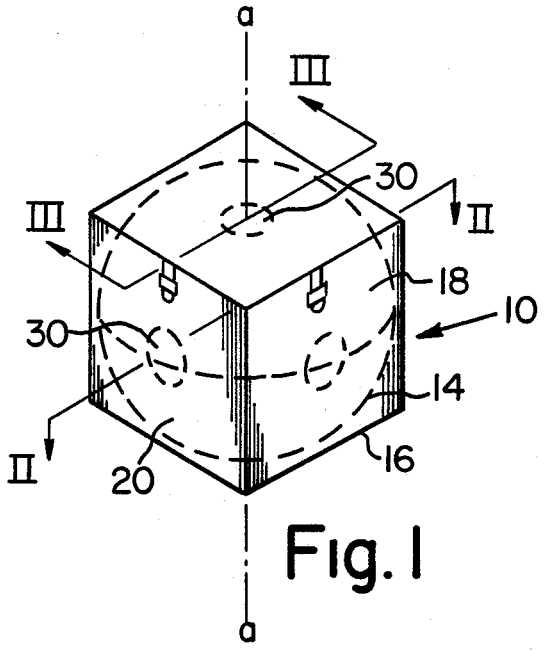
FIG. 1 is a perspective view of a shipping device according to the invention including a housing and a sphere having an upper hemisphere shell and a lower hemisphere shell.

Referring to the drawings, wherein like reference characters represent like elements, FIGS. 1–5 show a shipping device 10 for transporting an item 12 in a substantially fixed orientation.

The shipping device 10 includes a container 14 for holding the item(s) 12 which is concentrically positioned inside of a housing 16 by a gimbal arrangement such that the container always remains plumb. The container 14 is preferably of a hollow sphere type and may be made of any suitable material. The hollow sphere container, shown in FIGS. 1–4 is separable into two half portions, each half forming an upper hemisphere shell 18 and a lower hemisphere shell 20, respectively. The upper hemisphere shell 18 may have a step-shaped rim 22 designed to mesh with a complimentary rim 24 of the lower hemisphere shell 20 such that when the upper hemisphere shell is mounted upon the lower hemisphere shell, a unitary sphere is formed having an equatorial seam. In an alternate embodiment, the hemisphere shell 18 and 20 may each have a squared off rim as shown in FIG. 5. The hemisphere shells 18 and 20 are held in place relative to one another by virtue of the contact with housing 16 at gimbal bearings 30, the function of which will be explained in greater detail hereinafter. The hemisphere shells 18 and 20 may also be held in place relative to one another by the use of nylon fabric fastening strips such as that sold under the trademark "Velcro". The strips are adhesively bonded to the interior edge surfaces of the shells around the equatorial seam as shown in FIG. 5.

Figure 2:
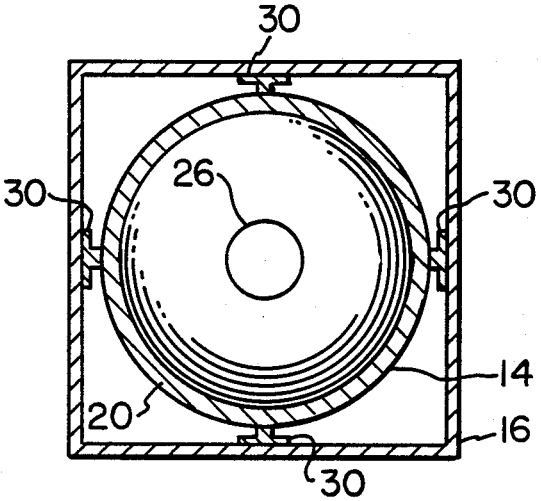
FIG. 2 is a cross-sectional view of the housing and the lower hemisphere shell of FIG. 1 taken along line II—II.
Figure 3:
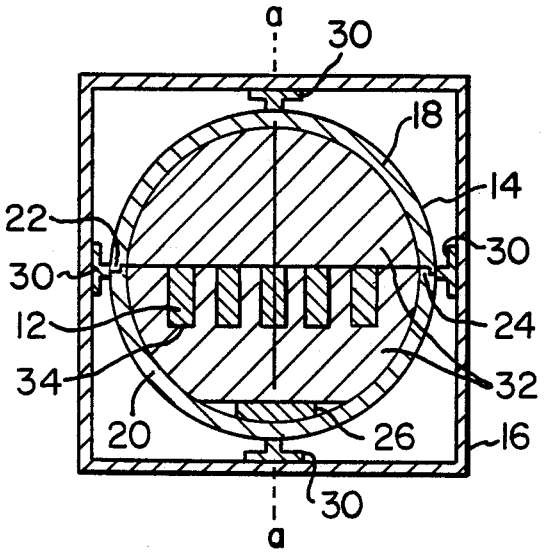
FIG. 3 is a cross-sectional view of the shipping device of FIG. 1 taken along line III—III.

The lower hemisphere shell 20 has secured thereto a means for balancing the sphere to maintain an imaginary vertical axis passing through the sphere represented by line a—a, substantially plumb regardless of the angle or position of the housing 16. Referring to FIG. 2, the means for balancing the sphere is secured to approximately the middle of the bottom of the lower hemisphere shell 20. The means for balancing the sphere may include a weight member 26 secured to the inside of the lower hemisphere shell or the lower hemisphere shell may have a weight member incorporated into the bottom of the lower hemisphere shell. The weight member may also be secured to the outer surface of the lower hemisphere shell, the only requirement being that the balancing means does not interfere with the free rotation of the sphere within the housing 16. The size of the weight member is a function of the weight of the item(s) 12 being transported and must be at least as heavy as the item(s). It will be appreciated that the weight member 26 acts as a counter balance to lower the center of gravity of the sphere such that when the orientation of the housing 16 is altered, the sphere is maintained in a plumb position by the force of gravity acting upon the weight member.

Figure 4:
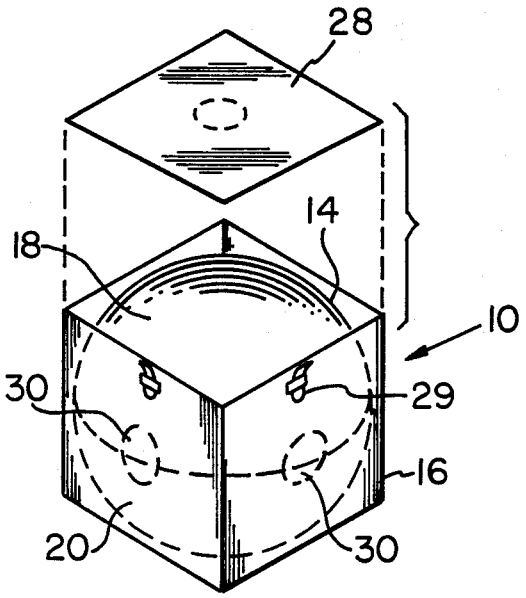
FIG. 4 is a perspective view of the shipping device of FIG. 1 with one face of the housing removed.
Figure 5:
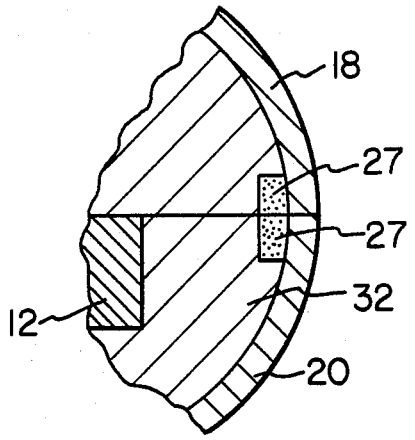
FIG. 5 is an enlarged partial view of the equatorial seam of the shipping device of FIG. 1.

As shown in FIGS. 1–4, the housing 16 is of a cubical frame design of six equal faces having a dimension slightly larger than the diameter of the sphere to restrain the linear motion of the sphere. A face 28 of the cubical frame is removably fastened, FIG. 4, to allow for easy access to the sphere positioned within the housing. Any conventional means may be utilized to removably fasten a face 28 of the cubical frame. FIG. 4 illustrates the use of clasps 29 to removably fasten a face 28 of the cubical frame. The housing 16 is preferably made from a material of a sufficient strength and stiffness to support the sphere and its contents yet light enough to allow for cost effective shipping of an item to be transported therein. In the drawings, the faces of the cubical frame of housing 16 are shown as solid panels, they can also be formed by interconnecting struts, in some applications, to form a light weight, open cubic frame structure (not shown).

The housing 16 has secured thereto bearing means for rotating the sphere relative to the housing. The rotating bearing means is secured to the center of the inward surface of each of the six faces of the cubical frame housing 16. The rotating bearing means may be conventional ball bearings 30 and the like and are typically secured to the center of each of the six faces of the cubical housing to operatively contact the surface of the sphere. It will be appreciated that any number of ball bearings 30 may be employed and positioned about the housing 16 to contact the sphere as long as the sphere is allowed to rotate freely with little or no translational movement.

In use, the sphere is typically packed with an energy absorbent material 32 such as a suitable foam material which may include polystyrene, polyurethane and the like. The energy absorbent material is preferably of a size and shape to fill the void of each hemisphere shell 18 and 20. The energy absorbent material 32 has a preformed cavity 34 therein shaped to accept and firmly hold the item(s) 12 to be transported. The item(s) 12 to be transported must be placed in an upright position within the cavity 34 of the energy absorbent material 32 in the sphere. The item(s) 12 must also be positioned such that the mass of the item(s) is not concentrated in the upper hemisphere shell 18 to insure that the center of gravity of the sphere remains close to the bottom of the lower hemisphere shell 20 to prevent the item(s) from counteracting the effects of the weight member 26. After the item(s) 12 to be transported is placed in the cavity 34 of the energy absorbent material 32 within the lower hemisphere shell 20, the upper hemisphere shell 18 is placed upon the lower hemisphere shell to form a unitary sphere and thereby enclose the item(s) within the sphere. The sphere may then be placed inside the cubical frame by way of the removable face 28. The face 28 is then fastened to the cubical framework thereby securely joining the upper hemisphere shell 18 and the lower hemisphere shell 20. It will be appreciated that the sphere and housing may be transported without further packaging or the sphere and housing may be further packaged for transport.

Having described presently preferred embodiments of the invention, it is to be understood that it may be otherwise embodied within the scope of the appended claims.

We claim:

1. A device for transporting an item in a specific orientation comprising:

(a) a housing comprising a cubical frame having six faces wherein at least one face is removably fastened to said frame;

(b) a container concentrically positioned within said housing for receiving said item;

(c) means for counterbalancing said container within said housing and for at least counterbalancing a weight of said item; and (d) bearing means to permit rotation of said container relative to said housing whereby, in use, as an orientation of said housing is altered, said container rotates within said housing responsive to said counterbalancing means to maintain said container in a specific orientation.

2. The device set forth in claim 1 wherein said bearing means is a plurality of ball bearings operatively contacting a surface of said container to allow said container to rotate freely within said housing.

3. The device set forth in claim 1 wherein said bearing means is a plurality of ball bearings each bearing secured to a center of each of said six faces of said cubical frame, whereby said bearings operatively contact surface of said container to allow said container to freely rotate with no translational movement.

4. The device set forth in claim 3 wherein said container is a sphere including an upper hemisphere shell and a lower hemisphere shell.

5. The device set forth in claim 1 wherein said counterbalancing means is a weight member.

6. The device set forth in claim 5 wherein said weight member is secured to the bottom of the inside of said lower hemisphere shell.

7. The device forth in claim 5 wherein said weight member is secured to the bottom of the outside of said lower hemisphere shell.

8. The device set forth in claim 5 wherein said weight member is incorporated into the bottom of the lower hemisphere shell.

9. The device set forth in claim 1 further comprising an energy absorbent material within said container, said energy absorbent material having a cavity therein shaped to hold the item to be transported.

10. The device set forth in claim 1 wherein said energy absorbent material is foam.

11. The device set forth in claim 1 where container is a sphere concentrically positioned within said housing including an upper hemisphere shell and a lower hemisphere shell, said upper hemisphere shell having a rim to mesh with a complimentary rim of said lower hemisphere shell such that when said upper hemisphere shell is mounted upon said lower hemisphere shell a unitary sphere is formed.

12. The device set forth in claim 11 wherein a first nylon fabric strip is secured to an interior edge surface of said upper hemisphere shell and a second nylon fabric strip is secured to an interior edge surface of said lower hemisphere shell such that when said upper hemisphere shell is mounted upon said lower hemisphere shell said first strip fastens to said second strip to form a unitary sphere.

13. A device for transporting an item in a specific orientation comprising:

(a) a cubical frame having six faces wherein at least one of said faces is removably fastened;

(b) a hollow sphere for receiving said item therein, said sphere concentrically positioned within said cubical frame, said hollow sphere including an upper hemisphere shell and a lower hemisphere shell, said upper hemisphere shell having a rim to mesh with a complimentary rim of said lower hemisphere shell;

(c) a weight member secured to a bottom of said lower hemisphere shell for at least counterbalancing the weight of said item; and (d) a plurality of ball bearings, each bearing secured to a center of each of said six faces for operatively contacting a surface of said hollow sphere such that as the orientation of said cubical frame is altered, said hollow sphere rotates within said cubical frame to maintain said hollow sphere in a specific orientation.

14. The device set forth in claim 13, further comprising an energy absorbent material within said hollow sphere, said energy absorbent material having a cavity therein shaped to hold the item to be transported.

15. The device set forth in claim 14 wherein said energy absorbent material is foam.

16. The device set forth in claim 15 wherein a first nylon fabric strip is secured to an interior edge surface of said upper hemisphere shell and a second nylon fabric strip is secured to an interior edge surface of said lower hemisphere shell such that when said upper hemisphere shell is mounted upon said lower hemisphere shell said first strip fastens to said second strip to form a unitary sphere.

* * * * *

UNITED STATES PATENT AND TRADEMARK OFFICE

CERTIFICATE OF CORRECTION

PATENT NO. : 4,919,300

DATED : April 24, 1990

INVENTOR(S) : Kristy L. Anderson and Edward R. Bollinger

It is certified that error appears in the above-identified patent and that said Letters Patent is hereby corrected as shown below:

Column 2 Line 17 "herein" should read --therein--.

Claim 10 Line 1 Column 5 "1" should read --9--.

Claim 11 Line 1 Column 5 "where" should read --wherein said--.

Signed and Sealed this

Twenty-third Day of July, 1991

*Attest:*

HARRY F. MANBECK, JR.

*Attesting Officer*

*Commissioner of Patents and Trademarks*